US010449407B1

(12) United States Patent
Abbas et al.

(10) Patent No.: US 10,449,407 B1
(45) Date of Patent: Oct. 22, 2019

(54) MEDICINE BALL AND METHOD OF CONSTRUCTION

(71) Applicant: Ali Abbas, Chak Behram Near Dalowali Sialkot (PK)

(72) Inventors: Ali Abbas, Sialkot (PK); Ahsan Ali, Sialkot (PK); Ali Imran, Sialkot (PK)

(73) Assignee: Ali Abbas, Sialkot (PK)

( * ) Notice: Subject to any disclaimer, the term of this patent is extended or adjusted under 35 U.S.C. 154(b) by 165 days.

(21) Appl. No.: 15/489,732

(22) Filed: Apr. 18, 2017

(51) Int. Cl.

| | |
|---|---|
| ***A63B 21/072*** | (2006.01) |
| ***B65B 1/04*** | (2006.01) |
| ***B65B 7/02*** | (2006.01) |
| ***A63B 21/06*** | (2006.01) |

(52) U.S. Cl.
CPC ..... *A63B 21/072* (2013.01); *A63B 21/0603* (2013.01); *B65B 1/04* (2013.01); *B65B 7/02* (2013.01)

(58) Field of Classification Search
CPC ..... A63B 21/072; A63B 21/0603; B65B 1/04; B65B 7/02
See application file for complete search history.

(56) References Cited

U.S. PATENT DOCUMENTS

| | | | | |
|---|---|---|---|---|
| 7,645,203 | B2 * | 1/2010 | Tang | A63B 41/085 473/604 |
| 7,803,092 | B2 * | 9/2010 | Gilliam | A63B 21/0004 482/132 |
| 9,155,950 | B2 * | 10/2015 | Fernandez | A63B 67/06 |
| 9,180,346 | B2 * | 11/2015 | Binette | A63B 37/0051 |
| 10,252,097 | B1 * | 4/2019 | Raines | A63B 21/0603 |
| 2005/0107227 | A1 * | 5/2005 | Massey | A63B 21/04 482/121 |
| 2005/0143234 | A1 * | 6/2005 | Massey | A63B 21/04 482/140 |
| 2005/0277499 | A1 * | 12/2005 | Tang | A63B 41/085 473/604 |
| 2009/0312159 | A1 * | 12/2009 | Gilliam | A63B 21/0004 482/93 |
| 2013/0109513 | A1 * | 5/2013 | Fernandez | A63B 67/06 473/585 |
| 2015/0111666 | A1 * | 4/2015 | Binette | A63B 37/0051 473/373 |
| 2017/0304685 | A1 * | 10/2017 | Iqbal | A63B 39/02 |

* cited by examiner

*Primary Examiner* — Garrett K Atkinson
(74) *Attorney, Agent, or Firm* — Michael D. Eisenberg

(57) ABSTRACT

A medicine ball comprises a cover made of a sheet of aramid fibers, having an exterior surface and an interior surface, that each comprise a coating of a polychloroprene compound. The coating is spread unevenly and is calendered across both the exterior surface of the cover and the interior surface of the cover. The exterior surface of the cover is embossed, which in addition to vulcanization, provides extra grip strength. The ball further comprises an interior space, which is filled with crushed pieces of ethylene vinyl acetate foam and rocks.

7 Claims, 6 Drawing Sheets

MEDICINE BALL AND METHOD OF CONSTRUCTION

TECHNICAL FIELD

The present invention relates to a medicine ball for exercising and rehabilitation of a human body, and method of making the same.

BACKGROUND OF THE INVENTION

The subject invention generally relates to a medicine ball, and method of making the same. Current medicine balls on the market are prone to bursting and losing shape over time with prolonged use. There is thus a need for a solution that corrects these issues, and addresses other issues such as improving blood circulation in a human body.

BRIEF SUMMARY OF EMBODIMENTS OF THE INVENTION

According to one embodiment, the present invention provides a medicine ball. The medicine ball comprises a cover. The cover comprises an exterior surface and an interior surface, each comprising a coating of a polymer compound. The coating is spread unevenly and is calendered across both the exterior surface of the cover and the interior surface of the cover. The exterior surface of the cover is embossed, which in addition to vulcanization, provides extra grip strength. The ball further comprises an interior space. A material fills the interior space.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
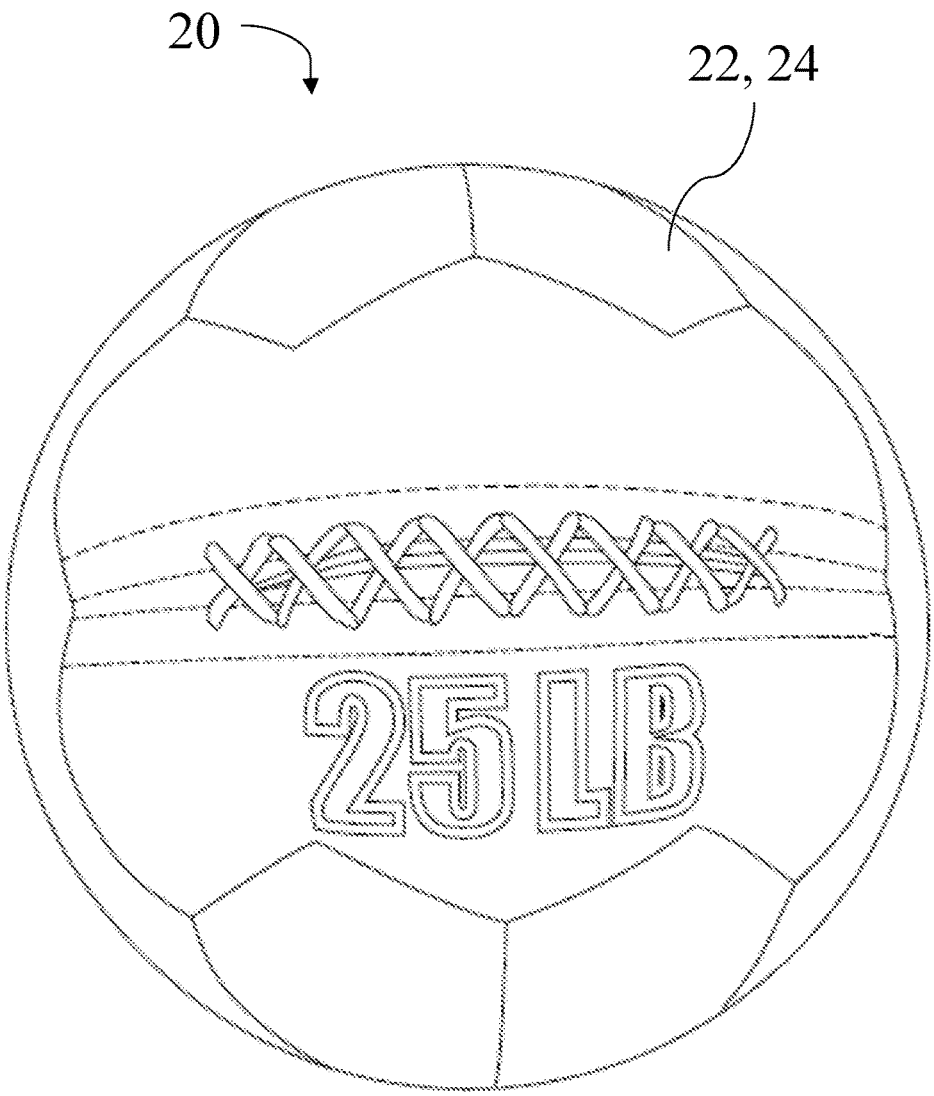
FIG. 1 is an aerial view of a preferred embodiment in accordance with the principles of the invention.
Figure 2:
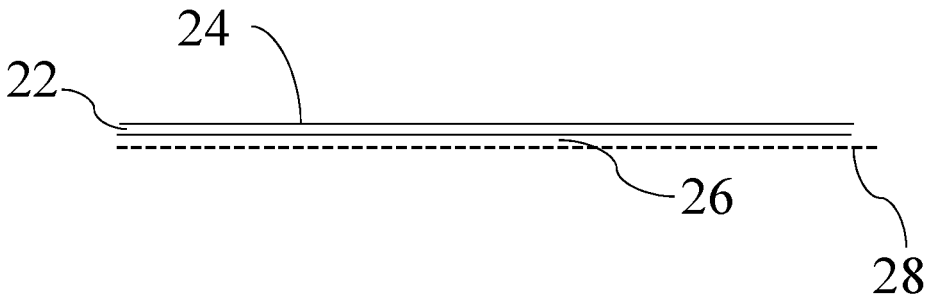
FIG. 2 is a first cross-sectional view of the preferred embodiment in accordance with the principles of the invention.
Figure 3:
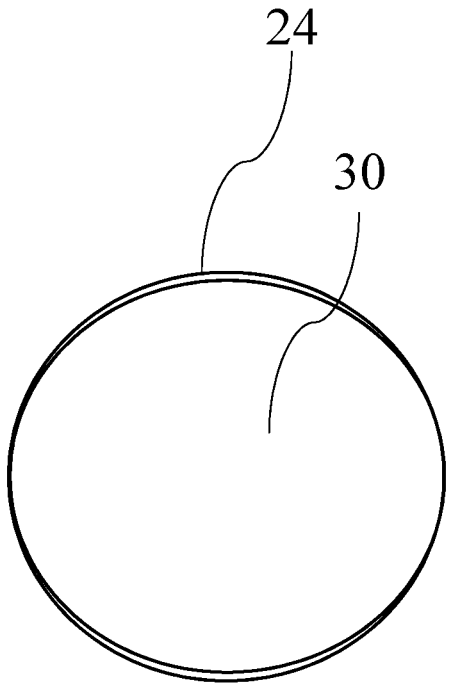
FIG. 3 is a first cut-away view of the preferred embodiment in accordance with the principles of the invention.
Figure 4:
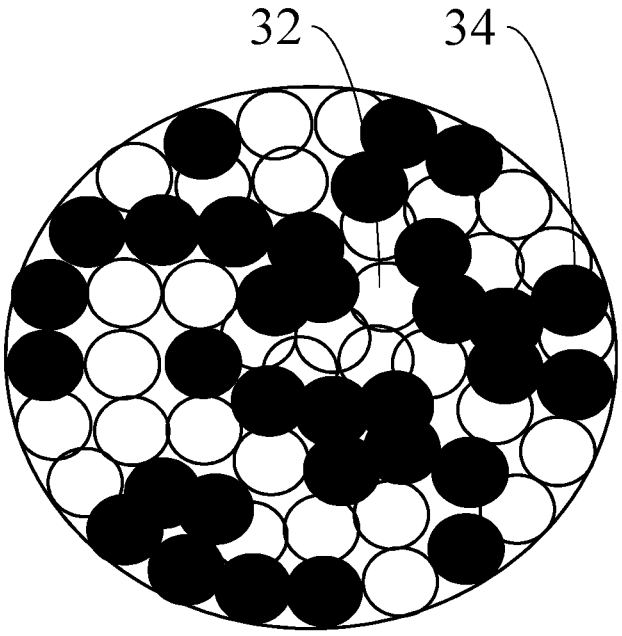
FIG. 4 is a second cut-away view of the preferred embodiment in accordance with the principles of the invention.

The present invention provides a medicine ball 20, depicted in FIG. 1. The medicine ball 20 comprises a cover 22, which is comprised of a fabric, specifically of vulcanized aramid fibers coated in rubber. The native aramid fibers have a basis weight of 200-300 gsm. The vulcanized aramid fibers have a tensile strength warp of 3400N/5 cm. Tensile strength warp and weft are 350N and 410N, respectively. Trapezoidal tear strength warp and weft are 1660N and 1390N, respectively. The cover 22 comprises an exterior surface 24 (FIG. 1) and an interior surface 26 (FIG. 2), each comprising a coating of a polymer compound, preferably a polychloroprene compound. The coating of the polymer compound is spread unevenly and is calendered across both the exterior surface 24 of the cover 22 and the interior surface 26 of the cover 22. On the interior surface 26 of the cover 22 is a coating of latex adhesive, which adheres to a sheet of canvas 28, as indicated in FIG. 2. The sheet of canvas 28 provides extra strength and is made of 100% knitted cotton. The coating of latex adhesive is preferably of polychloroprene, but can also be any of the following: chlorosulfonated polyethylene, ethylene propylene diene rubber, natural rubber, styrene-butadiene rubber, nitrile rubber, hydrogenated nitrile rubber, fluoroelastomer, and polyacrylic rubber. The exterior surface 24 of the cover 22 is embossed, which in addition to vulcanization, provides extra grip strength. The medicine ball 20 further comprises an interior space 30, indicated in FIG. 3. A material fills the interior space 30, and in a variant, the material comprises a foam 32 of ethylene vinyl acetate and a plurality of crushed rocks 34, both depicted in FIG. 4. The foam 32 is comprised of a 10-40% vinyl acetate by weight, with the rest being ethylene.

The basis weight of the resulting coated fabric is 610-630 gsm. The benefits of the ball made from this fabric are that it will not burst or lose shape over time with use. Also, the material properties of the fabric help to improve blood circulation throughout the human body.

Figure 5A:
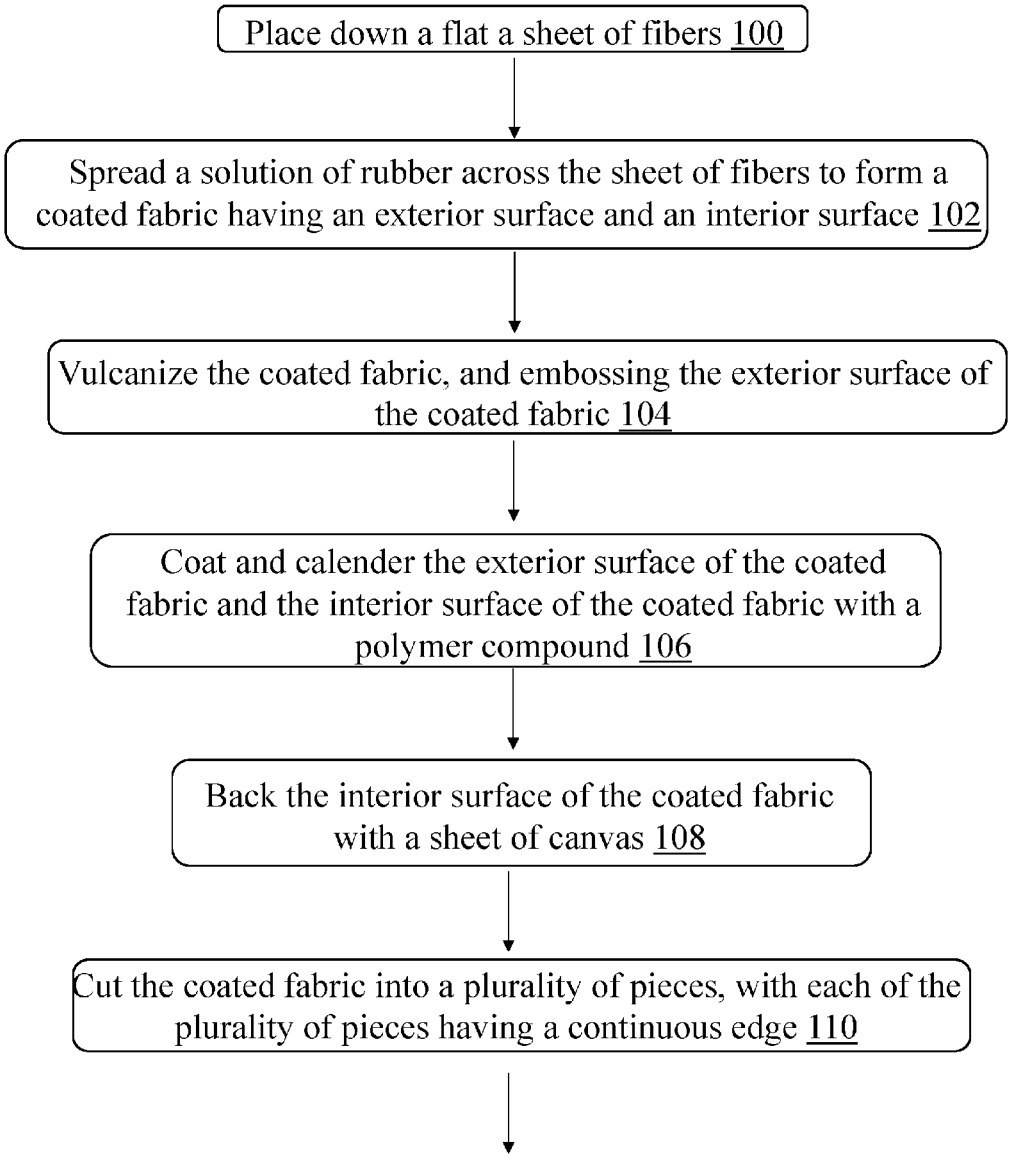
FIGS. 5*a* and 5*b* illustrate a flow chart of a method of making the preferred embodiment in accordance with the principles of the invention.
Figure 5B:
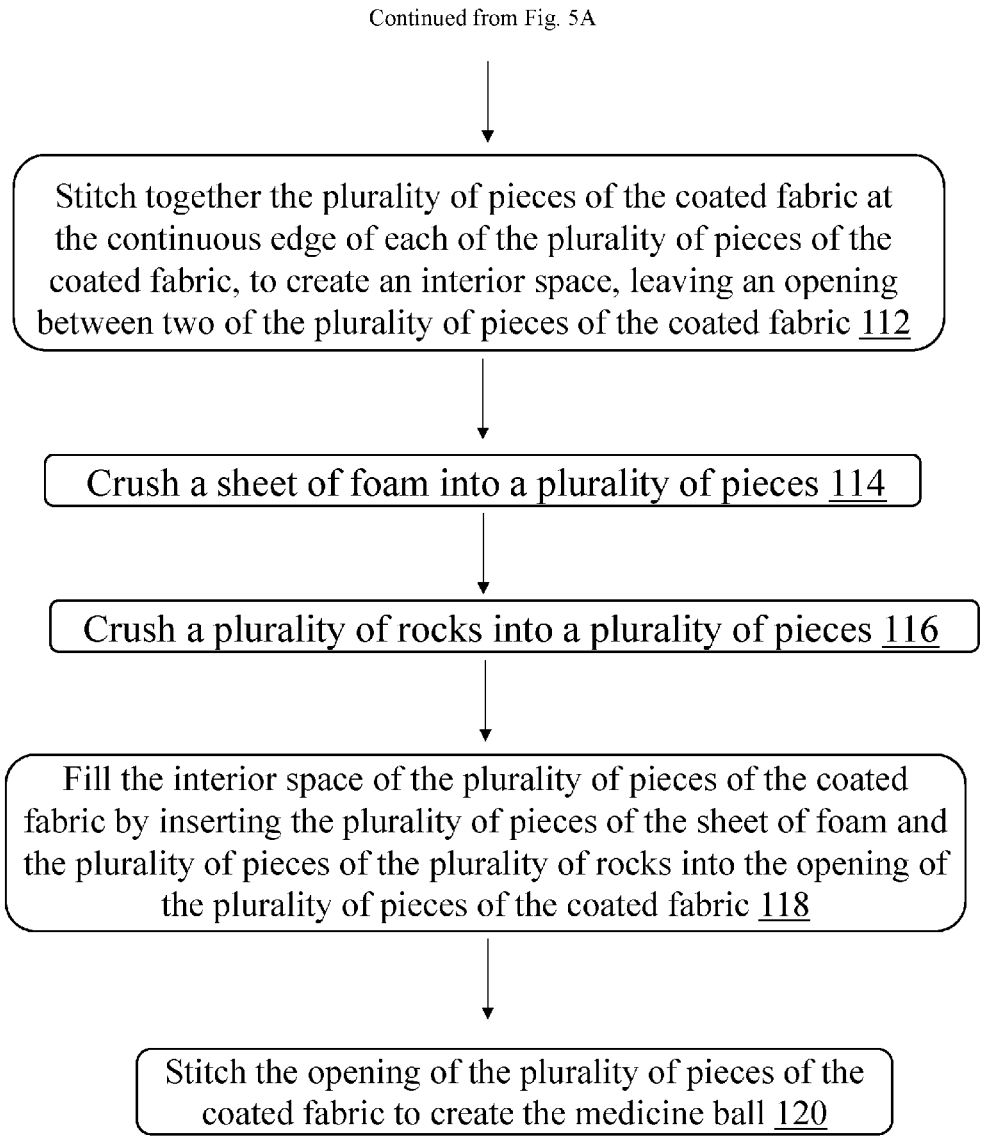

As illustrated in FIGS. 5*a* and 5*b*, a method of constructing a medicine ball comprises the following steps: a sheet of fibers, specifically aramid fibers, is placed down flat 100. A solution of rubber is spread across the sheet of fibers to form a coated fabric having an exterior surface and an interior surface 102. The coated fabric is vulcanized, and the exterior surface of the coated fabric is embossed 104. The exterior surface of the coated fabric and the interior surface of the coated fabric are both coated and calendered with a polymer compound, preferably a polychloroprene compound 106. The interior surface of the coated fabric is additionally coated with a latex adhesive (preferably polychoroprene), to provide adhesion to a sheet of canvas 108. The coated fabric is cut into a plurality of pieces, for instance by using a press die, with each of the plurality of pieces having a continuous edge 110. The plurality of pieces of the coated fabric are stitched together at the continuous edge of each of the plurality of pieces of the coated fabric, to create an interior space, leaving an opening between two of the plurality of pieces of the coated fabric 112. A sheet of foam, namely ethylene vinyl acetate foam, is crushed into a plurality of pieces 114. A plurality of rocks is crushed into a plurality of pieces 116. The interior space of the plurality of pieces of the coated fabric is filled by inserting the plurality of pieces of the sheet of foam and the plurality of pieces of the plurality of rocks into the opening of the plurality of pieces of the coated fabric 118. The opening of the plurality of pieces of the coated fabric is then stitched closed to create the medicine ball 120.

What is claimed is:

1. A method of constructing a medicine ball, comprising the steps of:

placing down flat a sheet of fibers;

spreading a solution of rubber across the sheet of fibers to form a coated fabric having an exterior surface and an interior surface;

vulcanizing the coated fabric and embossing the exterior surface of the coated fabric;

coating and calendering the exterior surface of the coated fabric and the interior surface of the coated fabric with a polymer compound;

coating the interior surface of the coated fabric with a latex adhesive;

backing the interior surface of the coated fabric with a sheet of canvas;

cutting the coated fabric into a plurality of pieces, with each of the plurality of pieces having a continuous edge;

stitching together the plurality of pieces of the coated fabric at the continuous edge of each of the plurality of pieces of the coated fabric, to create an interior space, leaving an opening between two of the plurality of pieces of the coated fabric;

crushing a sheet of foam into a plurality of pieces;

crushing a plurality of rocks into a plurality of pieces;

filling the interior space of plurality of pieces of the coated fabric by inserting the plurality of pieces of the sheet of foam and the plurality of pieces of the plurality of rocks into the opening of the plurality of pieces of the coated fabric; and stitching closed the opening of the plurality of pieces of the coated fabric.

2. The method of claim 1, wherein the sheet of fibers is a sheet of aramid fibers.

3. The method of claim 1, wherein the polymer compound is a polychloroprene compound.

4. The method of claim 1, wherein the latex adhesive is polychloroprene.

5. The method of claim 1, wherein the coated fabric is cut using a press die.

6. The method of claim 1, wherein the sheet of foam is a sheet of ethylene vinyl acetate foam.

7. The method of claim 1, wherein:

the sheet of fibers is a sheet of aramid fibers;

the polymer compound is a polychloroprene compound;

the latex adhesive is polychloroprene;

the coated fabric is cut using a press die;

the sheet of foam is a sheet of ethylene vinyl acetate foam.

* * * * *